United States Patent [19]

Gleim

[11] 4,120,664

[45] Oct. 17, 1978

[54] PRODUCTION OF LOW-SULFUR COAL POWDER FROM THE DISINTEGRATION OF COAL

[75] Inventor: William K. T. Gleim, Seattle, Wash.

[73] Assignee: Energy Modification, Inc., Gainesville, Fla.

[21] Appl. No.: 841,750

[22] Filed: Oct. 13, 1977

[51] Int. Cl.[2] ..... C10L 9/10; C10G 1/00

[52] U.S. Cl. ..... 44/1 R; 44/1 C; 208/8

[58] Field of Search ..... 44/1 R, 1 C; 201/17; 208/8

[56] References Cited

U.S. PATENT DOCUMENTS

| | | | |
|---|---|---|---|
| 2,739,105 | 3/1956 | Ford et al. | 201/17 |
| 3,985,517 | 10/1976 | Johnson | 44/1 R |
| 3,998,604 | 12/1976 | Hinkley | 44/1 R |
| 4,030,893 | 6/1977 | Keller | 44/1 R |

*Primary Examiner*—Carl Dees

[57] ABSTRACT

Small lumps of coal are contacted in an upflow confined reactor with liquid $SO_2$ and some recycled hydrocarbons at an elevated pressure to effect the disintegration of the coal to micro-sized dust particles and, preferably, the resulting coal dust and liquid $SO_2$ with entrained liquid hydrocarbons that are withdrawn from the top of the reactor will undergo a further pressurized centrifugal contact-separation step. The liquid stream from the latter is recycled to the upflow reactor while the coal dust is recovered for use as a carbonaceous fuel ready for economical pipeline transportation suspended in either gas or liquid, with the liquid being either water or oil. Alternatively, the dust may be subjected to liquification, or such other treatment as may be desired.

10 Claims, 1 Drawing Figure

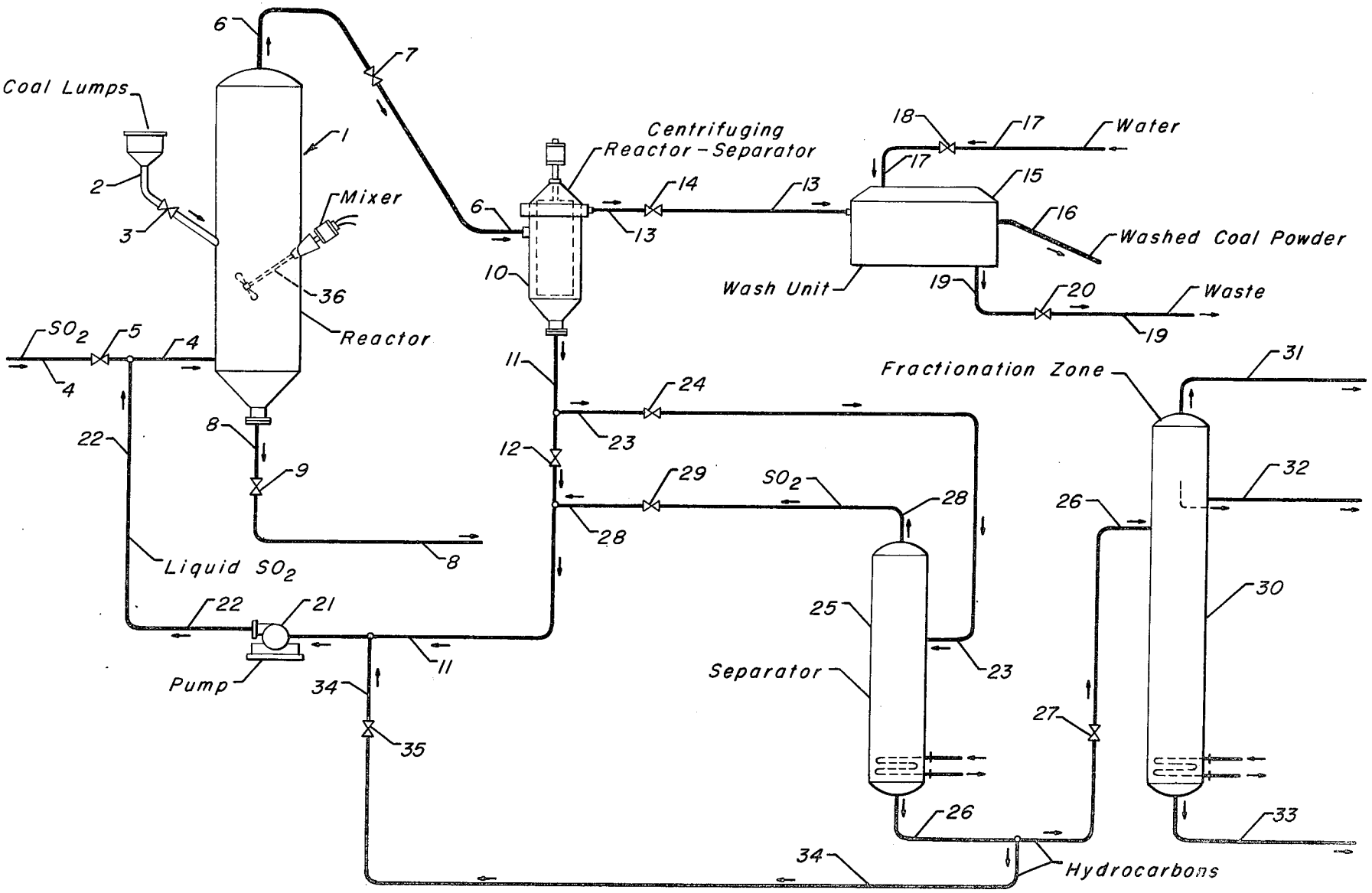
Coal Lumps
Mixer
Reactor
Centrifuging Reactor-Separator
Wash Unit
Water
Washed Coal Powder
Waste
Fractionation Zone
Separator
Hydrocarbons
Liquid $SO_2$
Pump
$SO_2$

PRODUCTION OF LOW-SULFUR COAL POWDER FROM THE DISINTEGRATION OF COAL

This invention relates to a method for disintegrating coal and producing a highly useful low ash-low sulfur content coal dust.

More particularly, the invention is directed to a process utilizing liquid sulfur dioxide ($SO_2$) to contact lump coal in an upflow system such that resulting coal powder and liquid $SO_2$ can be withdrawn from the top of the reactor for further treatment and separation, while pyrite, clay, shale, etc., will be permitted to sink to the bottom of the reactor for removal.

It is recognized that there are many processes for powdering coal. Most commercial operations involve mechanical crushing and powdering such that the dust can be blown into furnaces and boilers or into transfer pipe lines. However, such operations leave the undesired sulfur and clay contents so as to be of no advantage from ecological aspects.

The coals in the Western part of the United States, for example those west of the Mississippi, are mostly subbituminous, with a low BTU content and large amounts of ash, i.e., 10–20% by weight. Actually, the shipping of these types of coals by rail to the Eastern part of the United States and to centers of consumption becomes uneconomical and it is desirable to seek other ways of obtaining the fuel values. However, converting the coals into liquids by means of hydrogenation can also be uneconomical and a problem in regions that are short of water. In the liquification of coal there are large quantities of hydrogen that are required and this necessarily requires equally large amounts of water to be able to readily provide the necessary hydrogen. As another avenue, there may be the conversion of coals into electricity but this involves the burning of the coal for the production of steam to drive electric generators. The burning of large quantities of coal results again in ecological problems by reason of the creation of large quantities of ash as well as the production of sulfur dioxide. The damage from $SO_2$ is, of course, well known such that there is the need to remove it before the burning of the coal for the power generation or, alternatively, scrubbing the flue gases to free them from the $SO_2$ and preclude the resulting damage to the area. Most scrubbing operations, in turn, become quite expensive and involve the disposal of large quantities of lime, limestone dust, etc., which become saturated with $SO_2$ and must ultimately be disposed of in the same manner as coal ash. In connection with coal ash itself, there are small amounts of elements such as thallium, selenium, cadmium, arsenic, mercury, and other material which may be in amounts of 0.1 to 2 parts per million. These amounts may seem somewhat minute; however, experience has shown that the fly ash from a power plant stack will accumulate on the ground in a circle of not greater than about three miles so that there is an ever-increasing concentration of poisonous elements into plant life and animals in the immediate vicinity of the power plant.

As related to the present invention, it is known that dry coal lumps of bituminous coal can be disintegrated to fine dust by contact with liquid sulfur dioxide and it is herewith recognized that the procedure, as such, is a known art. The liquid $SO_2$ serves to depolymerize and dissolve the dienes which envelop and bind the coal which is a heterogenous mixture of clay, pyrite, shale, etc., and giant coal molecules or hydrocarbonaceous solids. With the removal of the enveloping dienes, the lump coal readily breaks up and coal particles of the order of 1 micron diameter, or less, will result. Is is, however, a feature of the present invention to provide an improved upflow system and an overall more efficient separation procedure that can be used on both bituminous and sub-bituminous coals.

Actually it may be considered a principal object of the present invention to conduct a coal dust producing operation where the lump coal is contacted in a vertically oriented reactor providing an upflow of the liquid $SO_2$. As a result, the $SO_2$ not only disintegrates the coal, but it also separates the coal from the heavier pyrite, clay, etc., which will settle to the lower end of the reactor to be removed as sediment. The inorganic sulfur will, to a large extent, also be withdrawn from the system with the heavier sediment materials.

It may also be considered an object of the present invention to employ an operation where the upflowing coal dust and liquid $SO_2$ with dissolved dienes is transferred from the upper end of the reactor to a centrifugal contact-separator unit which will operate under elevated pressure conditions.

A still further object of the invention is to provide a continuously operating system where coal is continuously fed to an upflow pressure tight reactor to contact liquid $SO_2$, and the latter with some entrained dienes, is continuously recovered and recycled from a separation zone back to the reactor zone. Excess dienes can be removed from the liquid $SO_2$ by a suitable distillation process as part of the overall system.

Still other objects and advantages of the present invention will be set forth in conjunction with the descriptive material provided hereinafter.

A principal advantage of the present system resides in the fact that after the separation of the resulting coal dust it is found that dust will be substantially ash free and will have lost up to two-thirds of its original sulfur content. The BTU content of the coal powder will also be of the order of 16,000 BTU per pound.

This coal dust can be used directly as a superior fuel for many usages since it is more readily burnable than heavy fuel oil or can be used directly in acidic fuel cells for electrical power production. On the other hand, the resulting low ash coal dust can be subjected to liquificiation where the end product is to be a hydrocarbon distillate. There is no object in liquifying the coal dust just to obtain a heavy fuel oil.

In a broad aspect the present invention embodies a method for producing a low ash-low sulfur content coal dust from small lumps of dry coal, which comprises, (a) mixing macro-sized coal lumps with a liquid $SO_2$ stream within a confined reaction zone and passing the mixture upwardly therein while at a temperature and elevated pressure sufficient to maintain the $SO_2$ in liquid phase to provide for a resulting separation of the lump coal into micro-sized coal particles and residue material, (b) withdrawing floating and suspended coal particles and liquid from the upper portion of the reaction zone and passing the mixture to a separation zone while still under superatmospheric pressure to provide for the separation of the micro-sized coal from the liquid $SO_2$ and resulting extracted hydrocarbons, (c) discharging and recovering the fine micro-sized particles as a desired low ash-low sulfur coal dust, and (d) recovering a separated liquid $SO_2$ stream from said separation zone for recycle to said reaction zone.

In another embodiment, the present invention will provide for a second stage contacting-centrifuging operation wherein the fine particles together with the liquid $SO_2$ from the upper portion of the reaction zone is subjected to pressurized centrifuging whereby there is a separation of the resulting coal dust and liquid $SO_2$ along with extracted hydrocarbons.

The centrifuging operation precludes settling chambers and makes a rapid separation of the particulates from the liquid material, as well as provides for a second stage of further contact between the liquid $SO_2$ and fine coal particles. Typically the resulting fine coal dust will be considered to be "micro-sized" particulates of less than about 1 micron average diameter. The coal lumps which are introduced into the reaction chamber for the upflow and contact with the liquid $SO_2$ will generally be referred to as "macro-sized" particles of from about 0.5 to 1 centimeter in average diameter; however, slightly smaller or larger particles may be utilized satisfactorily.

The reaction temperatures may vary from ambient or from say 0° to 100° C. with the pressure being sufficient to maintain the sulfur dioxide in a liquid state and generally less than about 10 atmospheres. To some degree the upper range of pressure will be limited by the mechanical considerations of the centrifuging equipment where such is being used in connection with a two-stage type of operation, i.e., the upflow reaction contact being followed by a pressurized centrifuging operation. In the reaction chamber the ratio of solvent to coal will be in the range of about 1:1 up to 5:1 with the optimal being of the order of 2:1.

In connection with a continuous type of operation, the liquid $SO_2$ plus hydrocarbons separated from the centrifuging zone can be recycled directly to the lower part of the reaction zone for reuse therein. It is to be noted that hydrocarbons, which may comprise the liquid solvent stream can comprise both $SO_2$ and diene along with aromatic hydrocarbons or merely one of the two types. It appears that the hydrocarbon content (dienes and/or aromatics) may comprise from 30–60% of the liquid stream; however, it is preferable to maintain the hydrocarbon content to about 50% or less of the total stream. Therefore, in a continuous processing system, it is of advantage to incorporate a distillation zone suitable for separating excess hydrocarbons from the recycled liquid $SO_2$ stream. Subsequent treatment of the separated hydrocarbons, comprising dienes or aromatics or both, and the extent of overall distillation to obtain a particular type of end product, as well as the operation to obtain a particular recycle stream, will, to some degree, depend upon whether one wants to obtain and sell aromatics or dienes as a byproduct material from the system. For example, it may be desirable to extract dienes as a raw material for use in the manufacture of plastics. Also another petrochemical advantage of dienes is making use of their ready convertibility to benzene, toluene and xylenes, as well as to hydrogen through the use of reforming catalysts. As a result it may be desirable to primarily carry out the recycling of only aromatics along with the liquid $SO_2$ to the reaction zone. It is also to be noted that aromatics are somewhat more easily handled in a processing system, being stable against polymerization and oxidation.

Reference to the accompanying drawing and the following description thereof will assist in the further understanding of the operation of the present invention as well as set forth further advantages in the particular processing sequence.

Referring now to the drawing, there is shown a reaction chamber 1 which is of an elongated vertically oriented upflow design that can be supplied with macro-sized lumps of coal by way of inlet means 2 and control valving 3. Liquid sulfur dioxide is indicated as being introduced into the lower portion of the chamber by way of line 4, having control valve 5, such that there is an upflow of the $SO_2$ through the reaction zone countercurrent to the downward flow of the coal lumps so as to result in an operation where the lumps will be broken up and disintegrated by the pressurized contact with the $SO_2$. Resulting fines will be carried upwardly to the top of the zone and carried overhead by way of line 6 to valve 7. At the same time the disintegrated coal lumps which contain heavier clay, shale and pyrite particulates will, in the countercurrent fluid system, provide for an ultimate settling of such heavier materials to the bottom of the reactor as sediment, while the fine powder coal particles will carry overhead to the top of the chamber. Thus, the heavier sediment materials are indicated in the present drawing as being withdrawn from the lower end of the reaction zone by way of line 8 and control valve 9 to be ultimately carried to disposal means.

As heretofore indicated for a preferred embodiment of the present invention, there will be the passage of fine coal particles and the upflowing liquid sulfur dioxide stream to a centrifugal separator which, preferably, will be of a type capable of operating under superatmospheric pressure such that they may be a still further disintegration effect between the liquid $SO_2$ and any remaining coal dust which may be more than micro-sized. Diagrammatically there is shown line 6 connecting with a centrifuging type reactor-separator at 10 and the removal of a slightly heavier liquid stream by way of line 11 and valve 12 while the fine coal particulates substantially free of heavier inorganic material, are being withdrawn by way of line 13 with valve 14. The latter is, in turn, indicated as discharging into a water wash unit at 15 so that washed coal powders free of $SO_2$ may be discharged at 16. Fresh water is indicated as being introduced by way of line 17 and valve 18 while waste water is being discharged by way of line 19 and valve 20. However, as will be described hereinafter, optional treating may be provided in lieu of the washing step.

The liquid $SO_2$ together with resulting dienes and aromatics which is being withdrawn by way of line 11 is indicated as passing through a high pressure pump at 21 to be recycled through line 22 and line 4 back into the lower part of the reactor. In order to indicate diagrammatically the provision of an overall system, there is further indicated a line 23 with valve 24 connecting to discharge line 11 such that the liquid $SO_2$ and diene-aromatic stream may be carried to a distillation-separation zone at 25. This zone will effect a fairly complete separation of the lower boiling $SO_2$ from the hydrocarbons and at least a part of the hydrocarbon stream is shown as being removed by way of line 26 and valve 27 while a reduced hydrocarbon content $SO_2$ stream is returned into the reactor system by way of line 28 and valve 29. In this case, line 28 is indicated as rejoining line 11 for transfer to the liquid $SO_2$ inlet line 4. Also, in accordance with the present invention, in order to provide for a controlled hydrocarbon content to the reactor 1, there may be a regulated quantity of dienes and aromatics from line 26, by way of line 34 and valve 35, to flow to line 11 and combine with the recycled $SO_2$.

There is also shown a fractionation zone 30 which can effect a further separation of the hydrocarbon stream being withdrawn by way of line 26. Actually, one or more fractionators may be used to effect any desired hydrocarbon separation for by-product usages or for obtaining a particular hydrocarbon stream to combine with the $SO_2$ for recycle. Zone 30 is, for illustrative purposes, shown as having upper, intermediate, and lower withdrawals at the respective lines 31, 32 and 33.

It is to be understood that the present drawing is merely diagrammatic in order to briefly illustrate the present processing system and that various modifications may be made as to types of equipment and the arrangement of zones within the scope of the invention. Also, as hereinbefore indicated, there may be modifications as to the extent of the sophistication of the distillation and fractionation area in order to provide for the separation of dienes and aromatics in lieu of merely providing for a particular ratio of hydrocarbon to liquid $SO_2$ in the contact stream reaching the reactor zone.

It may also be noted that where water is scarce, such as certain western areas, it may be inadvisable to try to effect a wash system for the fine micro-sized coal dust being withdrawn from the centrifuging zone; and such powder may be subjected to heating, say to the order of 100° C., in order to drive off entrained $SO_2$. In other words, wash zone 15 could be replaced with a heating and drying zone. The coal fines may also be stored or shipped wet and subsequently treated for $SO_2$ removal.

With regard to the centrifuging equipment, it is not intended to limit the present process to any one particular type of centrifuging unit; however, it is desirable to have one which will permit the heavier liquid $SO_2$ to be centrifuged from lighter coal dust, as well as operate at the superatmospheric pressure, preferably up to the order of about 5–10 atmospheres, in order to enhance the efficiency of the present twostage operation. For example, the centrifuge may be of the mechanical decanter type such as manufactured by the Escher-Wyss Company in Switzerland, or by the Kraus Maffei Company in Germany.

As still another modification, there may be utilization of mechanical or hydraulic stirring means within the reaction zone 1. In other words, there may be the use of one or more propellor type stirrer means such as indicated at 36, or, alternatively, there may be special nozzle arrangements for the introduction of the liquid $SO_2$ stream into the reactor at one or more levels such that there is high turbulence to in turn insure the fluidization and efficient contacting of the coal lumps being introduced into the mid-zone of the reaction chamber. In any event, it is not intended to limit the present invention to any one means for obtaining turbulence and contact in the reactor area.

In order to further illustrate the advantages of the present operation in providing a fine micro-sized coal particle from lump coal and at the same time obtain the advantage of reduced sulfur content, the following examples are set forth.

EXAMPLE I

In a reactor chamber having an internal diameter of 6 centimeters and a length of 30 centimeters, providing 850 milliliters volume, there is fed an Arizona coal containing 13.6% ash and 0.6% sulfur. The coal is crushed to macro-sized particles of 0.5 to 1 centimeter average diameter. The rate of coal introduction is 250 grams/hr. at the midportion of the reactor while the rate of liquid $SO_2$ introduction is at the rate of 500 ml/hr. being introduced near the bottom of the reactor. The temperature is of the order of 30° C.

A resulting fine coal and liquid sulfur dioxide is withdrawn from the top of the reactor. In the resulting coal dust product the ash is reduced to the level of about 0.09% while the sulfur content is reduced to about 0.3%. It is also to be noted that approximately 2 grams of dienes may be extracted per hour so as to increase the concentration of dienes in the overall stream. For short duration operations there is no need to regenerate the liquid $SO_2$; however, in a continuous process there will be the ultimate need to regenerate the liquid $SO_2$ by simple overhead distillation at ambient temperatures.

EXAMPLE I-A

In the same type of operation as hereinabove set forth, where a bituminous No. 6 Illinois coal is subjected to the indicated treatment, the ash would be reduced from about 7.8% to about 0.05% and the sulfur from about 2.9% to about 0.8%.

EXAMPLE II

In a test reactor of the size set forth in Example I, a Montana coal containing 15.8% ash and 0.8% sulfur is treated at 60° C. with 500 ml/hr. of a solvent stream which consists of 250 ml of benzene and 250 ml of liquid sulfur dioxide. In this instance there is an ash reduction to the level of about 0.07% and a reduction in the sulfur content to about 0.4%.

EXAMPLE III

In another instance, 250 grams/hr. of a Utah coal containing 7.7% ash and 0.7% sulfur is treated in the reactor described in Example I at a temperature of 80° C. with 500 ml/hr. of a solvent stream consisting of 250 ml of sulfur dioxide and 250 ml of a mixture of dihydrotoluene and dihydroxylenes. In this instance the ash is reduced to the level of about 0.06% and the sulfur content reduced to about 0.4%.

Again it is to be noted that the present invention should not be limited to the use of any particular diene or aromatic in combination with the liquid sulfur dioxide, although the overall percentage of hydrocarbon to $SO_2$ should be limited as heretofore noted to preferably not more than about 50% to 60% of the stream. The aromatics may comprise benzene, toluene, xylene, etc., while the dienes may comprise dihydrotoluene, dihydroxylenes, etc., and alternatively, there may be mixtures of both aromatics and dienes in the hydrocarbon portion of the stream.

I claim as my invention:

1. A method for producing a low ash-low sulfur content coal dust from small lumps of dry coal, which comprises, (a) mixing macro-sized coal lumps with a liquid $SO_2$ stream within a confined reaction zone and passing the mixture upwardly therein while at a temperature and elevated pressure sufficient to maintain the $SO_2$ in liquid phase to provide for a resulting separation of the lump coal into micro-sized coal particles and residue material, (b) withdrawing floating and suspended coal particles and liquid from the upper portion of the reaction zone and passing the mixture to a separation zone while still under superatmospheric pressure to provide for the separation of the micro-sized coal from the liquid $SO_2$ and resulting extracted hydrocarbons, (c) discharging and recovering the fine micro-sized particles as a desired low ash-low sulfur coal dust, and (d) recovering the separated liquid $SO_2$ stream from said separation zone for recycle to said reaction zone.

2. The method of claim 1 further characterized in that said mixture to said separation zone is further subjected to contact under pressurized centrifuging conditions and the separation of the resulting fine coal dust and liquid $SO_2$ with extracted hydrocarbons is effected by centrifugal action.

3. The method of claim 2 still further characterized in that the separated fine coal particles are subjected to a water wash to effect the removal of entrained $SO_2$.

4. The method of claim 2 still further characterized in that the separated fine coal particles are subjected to heating to effect the freeing of entrained $SO_2$ from the particles.

5. The method of claim 1 further characterized in that the liquid $SO_2$ stream may comprise a mixture of hydrocarbons selected from the group of aromatics, dienes, and the combination thereof, wherein the hydrocarbon portion of the stream is not greater than about 60% of such stream.

6. The method of claim 1 further characterized in that the ratio of the liquid $SO_2$ stream to coal is in the range of from about 1:1 to about 5:1.

7. The method of claim 1 further characterized in that mechanical agitation is used in said reaction zone to enhance the contact between the coal lumps and the liquid $SO_2$.

8. The method of claim 1 further characterized in that said liquid $SO_2$ stream is introduced into said reaction zone from multiple inlet ports and the resulting multiple streams have a velocity sufficient to provide turbulence and enhanced contact between the coal lumps and the liquid $SO_2$.

9. The method of claim 1 further characterized in that the separated liquid $SO_2$ stream from the separation zone is subjected to a distillation operation to separate hydrocarbons from the $SO_2$ and a controlled quantity of hydrocarbons, to provide for not more than about 60% by volume of the total liquid stream, is combined with the $SO_2$ being recycled to the reaction zone.

10. The method of claim 9 still further characterized in that the resulting separated hydrocarbons are subjected to fractionation to recover the dienes separate and apart from the other hydrocarbons and thereby provide a valuable product stream from the processing system.

* * * * *